US008708843B1

(12) United States Patent
Sekac et al.

(10) Patent No.: US 8,708,843 B1
(45) Date of Patent: Apr. 29, 2014

(54) BALL TRAINING SYSTEM FOR PITCHERS

(76) Inventors: David A. Sekac, Brentwood, NY (US); Reynold A. Martin, Montclair, NJ (US)

( * ) Notice: Subject to any disclaimer, the term of this patent is extended or adjusted under 35 U.S.C. 154(b) by 127 days.

(21) Appl. No.: 13/291,135

(22) Filed: Nov. 8, 2011

Related U.S. Application Data

(60) Provisional application No. 61/412,025, filed on Nov. 10, 2010.

(51) Int. Cl.
*A63B 69/00* (2006.01)
*A63B 37/00* (2006.01)

(52) U.S. Cl.
USPC ..... 473/451; 473/422; 473/458; 473/600

(58) Field of Classification Search
USPC ..... 473/422, 451, 450, 458, 598, 613, 600, 473/596; D21/707
See application file for complete search history.

(56) References Cited

U.S. PATENT DOCUMENTS

| | | | | | |
|---|---|---|---|---|---|
| D235,358 | S | * | 6/1975 | Dufaud | D21/707 |
| 4,128,238 | A | * | 12/1978 | Newcomb et al. | 473/451 |
| 4,871,169 | A | * | 10/1989 | Autorino et al. | 473/613 |
| 4,955,620 | A | * | 9/1990 | Reinke | 473/613 |
| 5,472,187 | A | * | 12/1995 | Kempf | 473/451 |
| 5,984,813 | A | * | 11/1999 | Cinnella | 473/613 |
| 7,070,184 | B2 | * | 7/2006 | Pollu | 273/123 R |
| 7,247,106 | B1 | * | 7/2007 | Brandt | 473/451 |

* cited by examiner

*Primary Examiner* — Mitra Aryanpour

(57) ABSTRACT

A ball training system for pitchers for effectively improving the pitching abilities of a baseball or softball pitcher. The ball training system for pitchers generally includes a ball training device including a core having a first side and a second side, an exterior cover surrounding a portion of the core, a plurality of seams attached to the exterior cover, a first cover attached to the first side of the core, and a second cover attached to the second side of the core. The first side and the second side of the core are each preferably planar and parallel to one another. When the ball training device is properly thrown by a pitcher, the ball training device's flight is substantially smooth and if the improperly thrown the ball training device will wobble inflight.

18 Claims, 12 Drawing Sheets

BALL TRAINING SYSTEM FOR PITCHERS

CROSS REFERENCE TO RELATED APPLICATIONS

I hereby claim benefit under Title 35, United States Code, Section 119(e) of U.S. provisional patent application Ser. No. 61/412,025 filed Nov. 10, 2010. The 61/412,025 application is currently pending. The 61/412,025 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to baseball training systems and more specifically it relates to a ball training system for pitchers for effectively improving the pitching abilities of a baseball or softball pitcher.

2. Description of the Related Art

Any discussion of the related art throughout the specification should in no way be considered as an admission that such related art is widely known or forms part of common general knowledge in the field.

Conventional baseball and softball pitching techniques involve utilizing a conventional ball. The student is taught to grip the ball in the desired location to achieve a desired pitch (e.g. four-seam fastball, two-seam fastball, curveball, slider, etc.). The main problem with conventional pitching techniques is that it can be difficult to determine if the student had the proper grip and release to achieve the optimal pitch characteristic.

Because of the inherent problems with the related art, there is a need for a new and improved ball training system for pitchers for effectively improving the pitching abilities of a baseball or softball pitcher.

BRIEF SUMMARY OF THE INVENTION

The invention generally relates to a baseball training system which includes a ball training device including a core having a first side and a second side, an exterior cover surrounding a portion of the core, a plurality of seams attached to the exterior cover, a first cover attached to the first side of the core, and a second cover attached to the second side of the core. The first side and the second side of the core are each preferably planar and parallel to one another. When the ball training device is properly thrown by a pitcher, the ball training device's flight is substantially smooth and if the improperly thrown the ball training device will wobble inflight.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
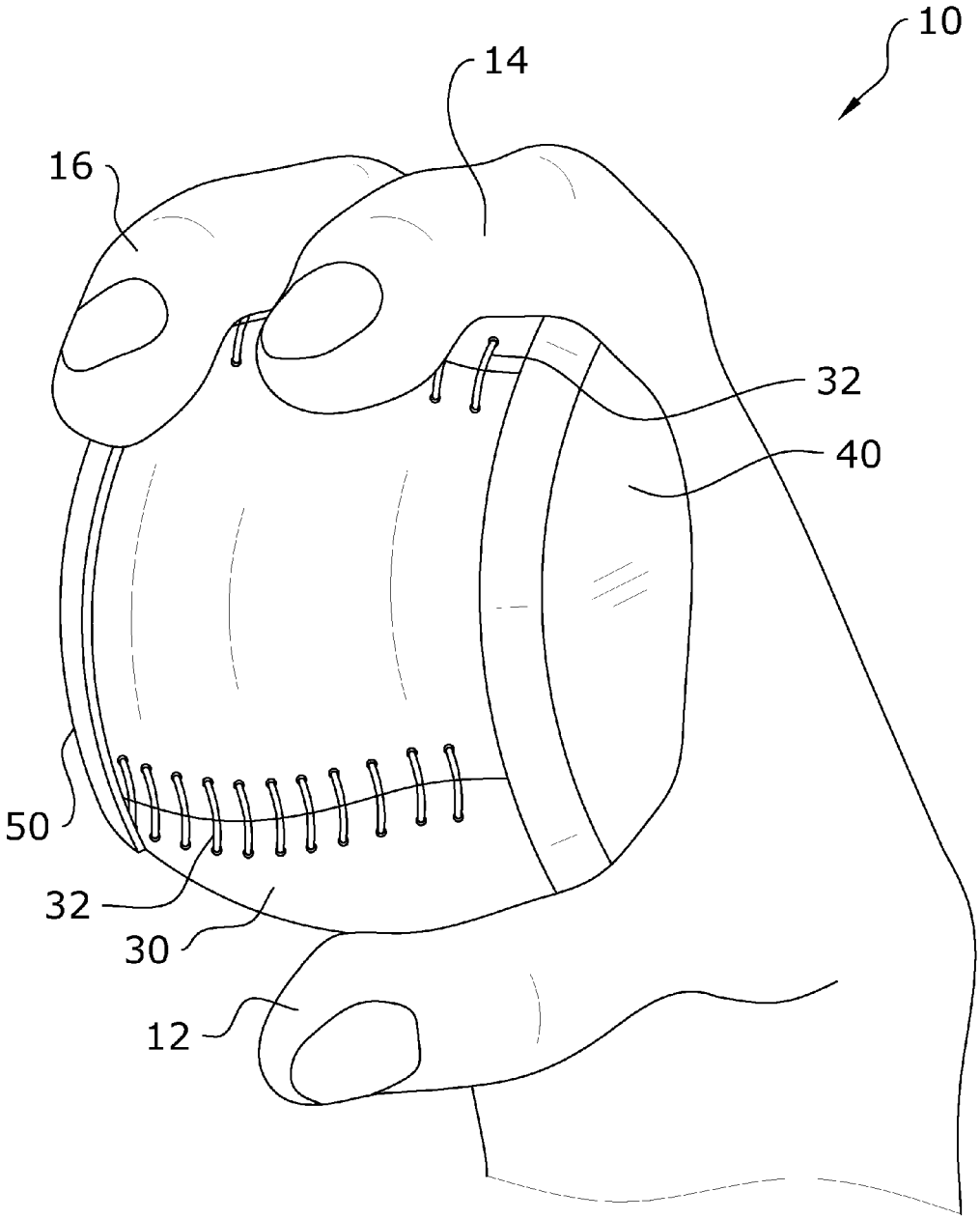
FIG. 1 is an upper perspective view of the present invention being gripped by the hand of a student in a four-seam fastball grip.
Figure 2:
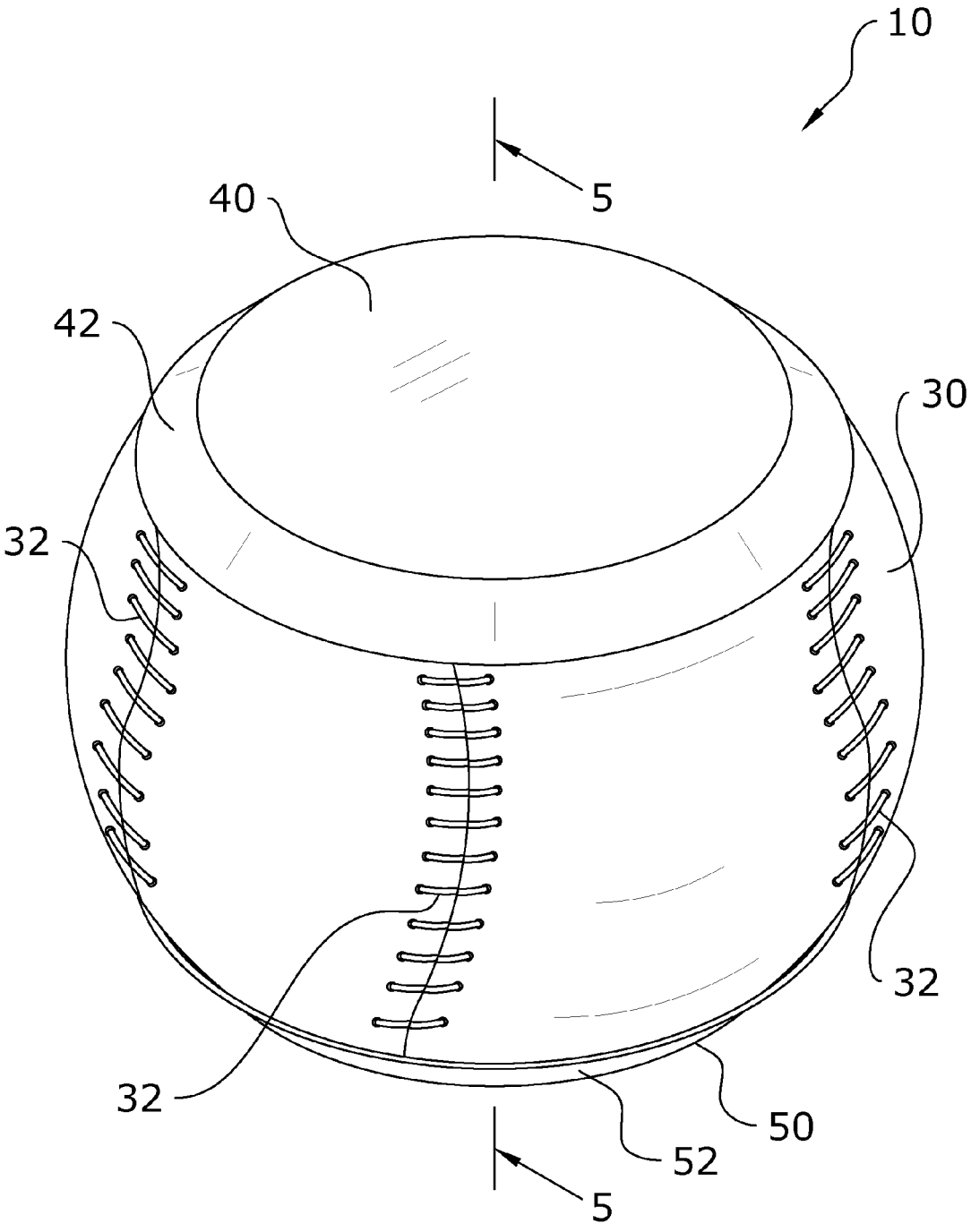
FIG. 2 is an upper perspective view of the first embodiment of the present invention.

A. Overview.

Turning now descriptively to the drawings, in which similar reference characters denote similar elements throughout the several views, FIGS. 1 through 12*c* illustrate a ball training device 10 including a core 20 having a first side 22 and a second side 24, an exterior cover 30 surrounding a portion of the core 20, a plurality of seams 32 attached to the exterior cover 30, a first cover 40 attached to the first side 22 of the core 20, and a second cover 50 attached to the second side 24 of the core 20. The first side 22 and the second side 24 of the core 20 are each preferably planar and parallel to one another. When the ball training device 10 is properly thrown by a pitcher, the ball training device 10's flight is substantially smooth and if the improperly thrown the ball training device 10 will wobble inflight. It can be appreciated that the present invention may be utilized by various baseball and softball athletes (e.g. shortstop, outfielder, etc.) and should not be considered limited to just pitchers. In particular, the present invention is designed to assist pitchers and all other ball players throw the ball in a desired manner.

B. Core.

FIGS. 3, 5, 7, 8, 10 and 11 illustrate the core 20 as used within the present invention. The core 20 may be comprised of various types of materials capable of simulating a baseball or softball. It is preferable to have the core 20 comprised of rubber and cork winded with wool and yarn which is commonly utilized to construct a baseball.

The core 20 includes a first side 22, a second side 24 and a middle portion between the first side 22 and the second side 24. The middle portion is comprised of a spherical shape similar to that of a baseball or a softball. The middle portion has a curvature and diameter similar to that of a conventional baseball or softball. The diameter of the middle portion is approximately between 2.87 to 2.94 inches for a baseball.

The first side 22 and the second side 24 are not spherical shaped. Preferably, the first side 22 and the second side 24 are planar as illustrated in FIGS. 3, 5, 7, 8, 10 and 11.

Figure 4:
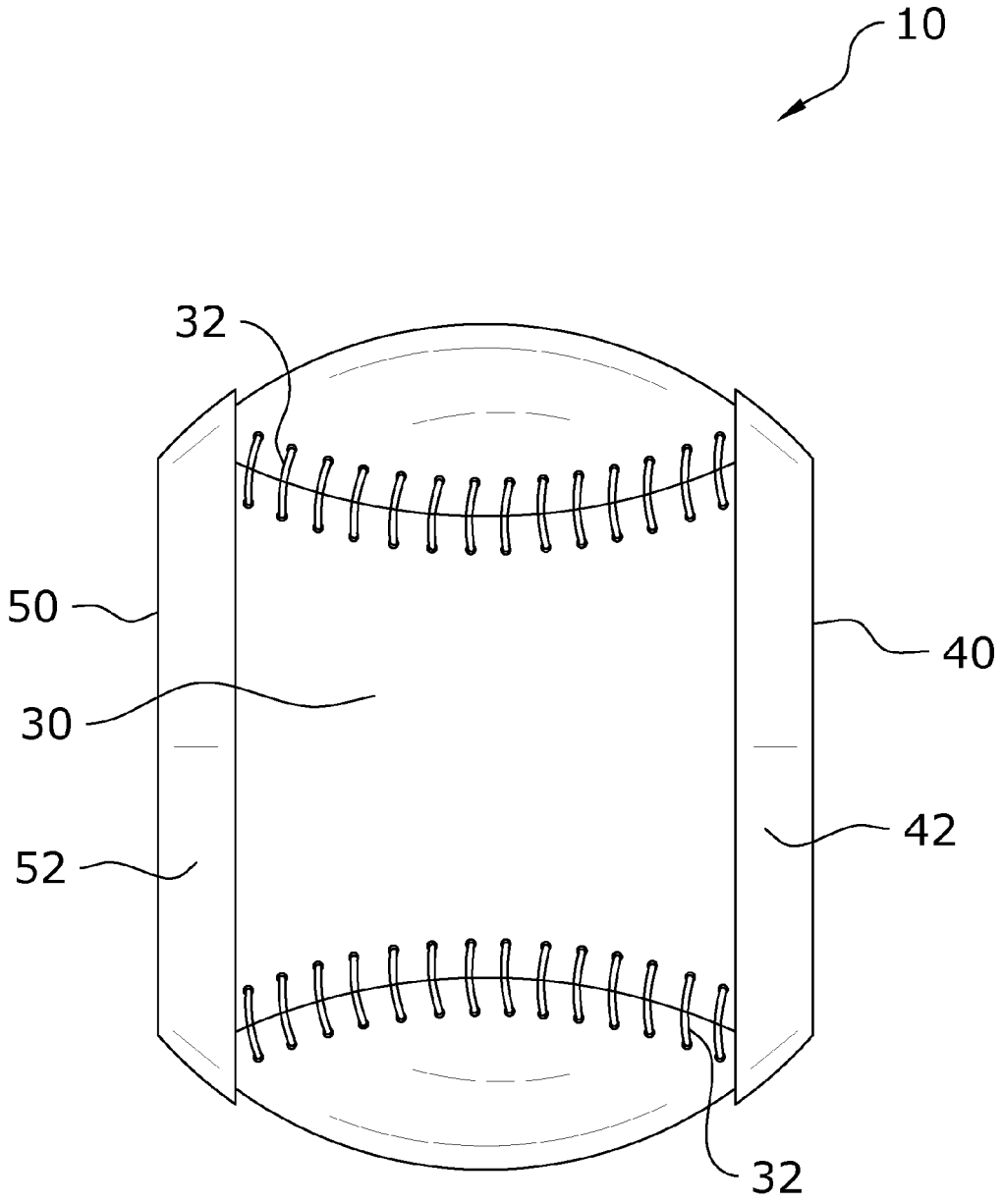
FIG. 4 is a side view of the first embodiment of the present invention.
Figure 5:
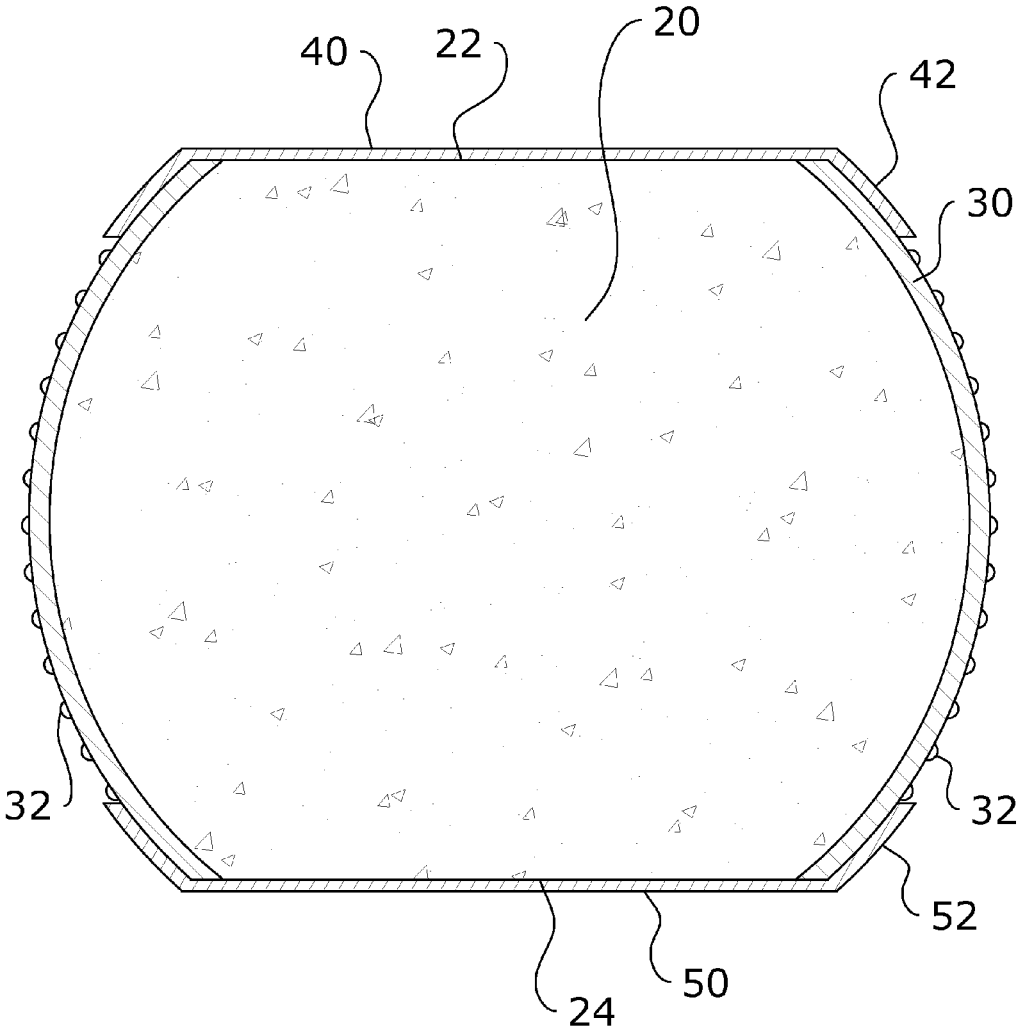
FIG. 5 is a cross sectional view taken along line 5-5 of FIG. 2.

In addition, the first side 22 and the second side 24 are preferably substantially parallel to one another as best illustrated in FIGS. 4 and 5 of the drawings. Furthermore, the first side 22 and the second side 24 are preferably circular in shape and equal in size. The first side 22 and the second side 24 are further preferably concentric with one another. With respect to a baseball, the first side 22 is preferably distally spaced from the second side 24 between 1.75 inches to 2 inches as illustrated in FIGS. 4 and 5 of the drawings.

C. Covers.

Figure 3:
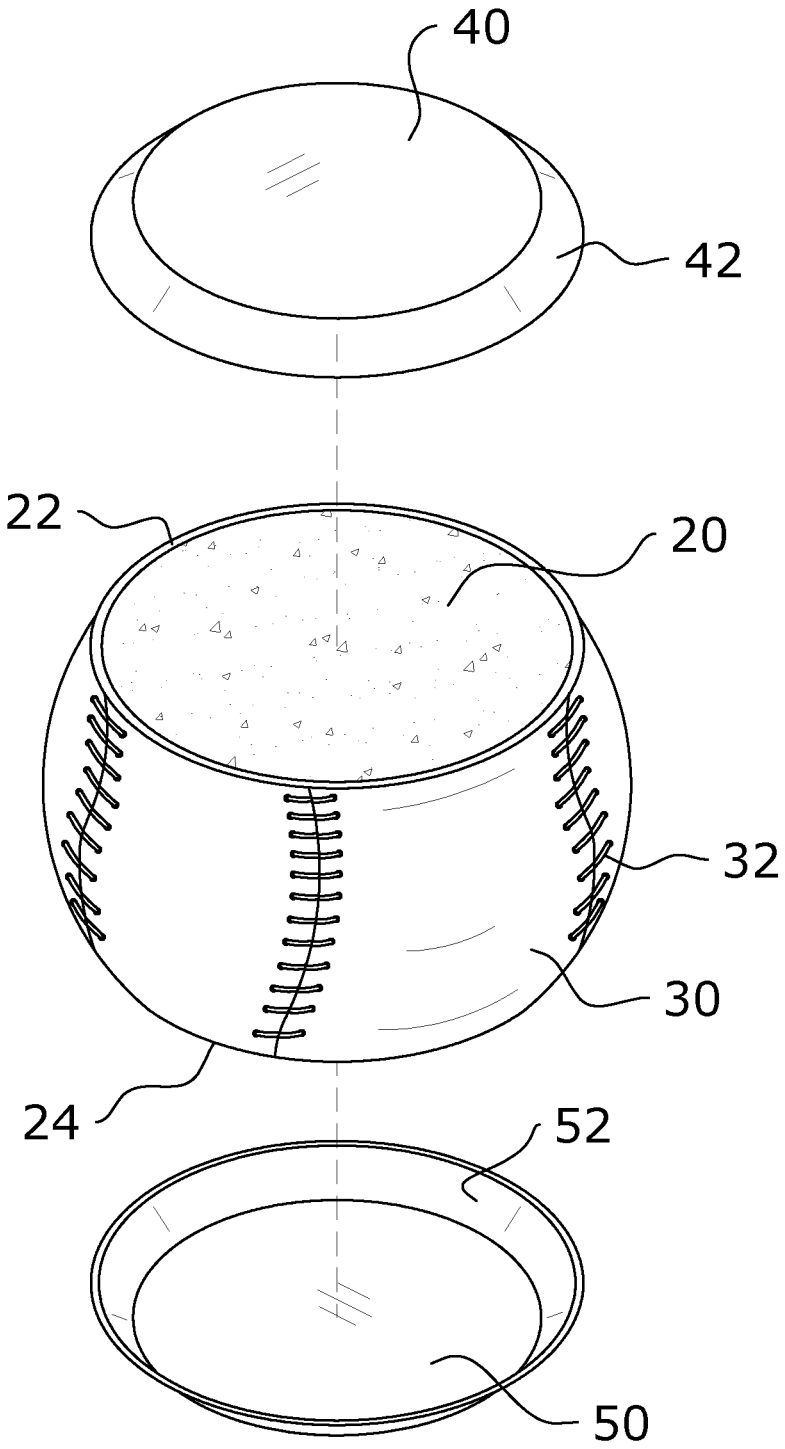
FIG. 3 is an exploded upper perspective view of the first embodiment of the present invention.

The exterior cover 30 surrounds the middle portion of the core 20 is best illustrated in FIG. 3 of the drawings. The exterior cover 30 may be comprised of a single piece of material or a plurality of pieces of material. The exterior cover 30 is preferably comprised of a material commonly utilized with respect to conventional baseballs and softballs (e.g. leather). The exterior cover 30 when attached to the core 20 has two side openings that expose the first side 22 and the second side 24 of the core 20.

A plurality of seams 32 are attached to the exterior cover 30 representing seams 32 of a baseball or a softball. Seams are comprised of stitching that connections the different portions of the exterior cover 30. The seams 32 are raised similar to a conventional baseball or softball to simulate the gripping experienced by a pitcher. FIGS. 4, 12*a*, 12*b* and 12*c* show the different patterns that may be created on the exterior cover 30 with the seams 32 to simulate various types of pitches.

A first cover 40 is preferably attached to the first side 22 and a second cover 50 is preferably attached to the second side 24 of the core 20 as shown in FIGS. 3, 4 and 5 of the drawings. The first cover 40 and the second cover 50 are preferably comprised of the same material as the exterior cover 30 such as but not limited to leather (cowhide, horsehide). It is important that when the covers 30, 40, 50 are attached that the overall feel of the ball training device 10 be similar to that of a conventional baseball or softball.

The first cover 40 preferably includes a first overlap portion 42 that extends over a portion of the exterior cover 30 as shown in FIG. 5 of the drawings. The second cover 50 includes a second overlap portion 52 that extends over a portion of the exterior cover 30 as shown in FIG. 5 of the drawings. The first cover 40 and the second cover 50 are preferably attached to the core 20 and the exterior cover 30 with an adhesive or related fastening material. It can be appreciated that the exterior cover 30, the first cover 40 and the second cover 50 may be comprised of a single piece of material or multiple pieces of material.

D. Weight.

While a weight is not required as shown in FIGS. 1 through 5 of the drawings, it is preferable that at least one weight is attached to the core 20 to compensate for the loss of weight because of the reduced core 20. It is preferable that the overall weight of the ball training device 10 be approximately the same as a regulation baseball or regulation softball.

In particular, the weight added to the core 20 ensures that the overall weight of the ball training device 10 is approximately that of a conventional baseball. The weight also can assist in providing tactile feedback to the pitcher during the pitch and providing the wobbling effect if not properly thrown.

Figure 6:
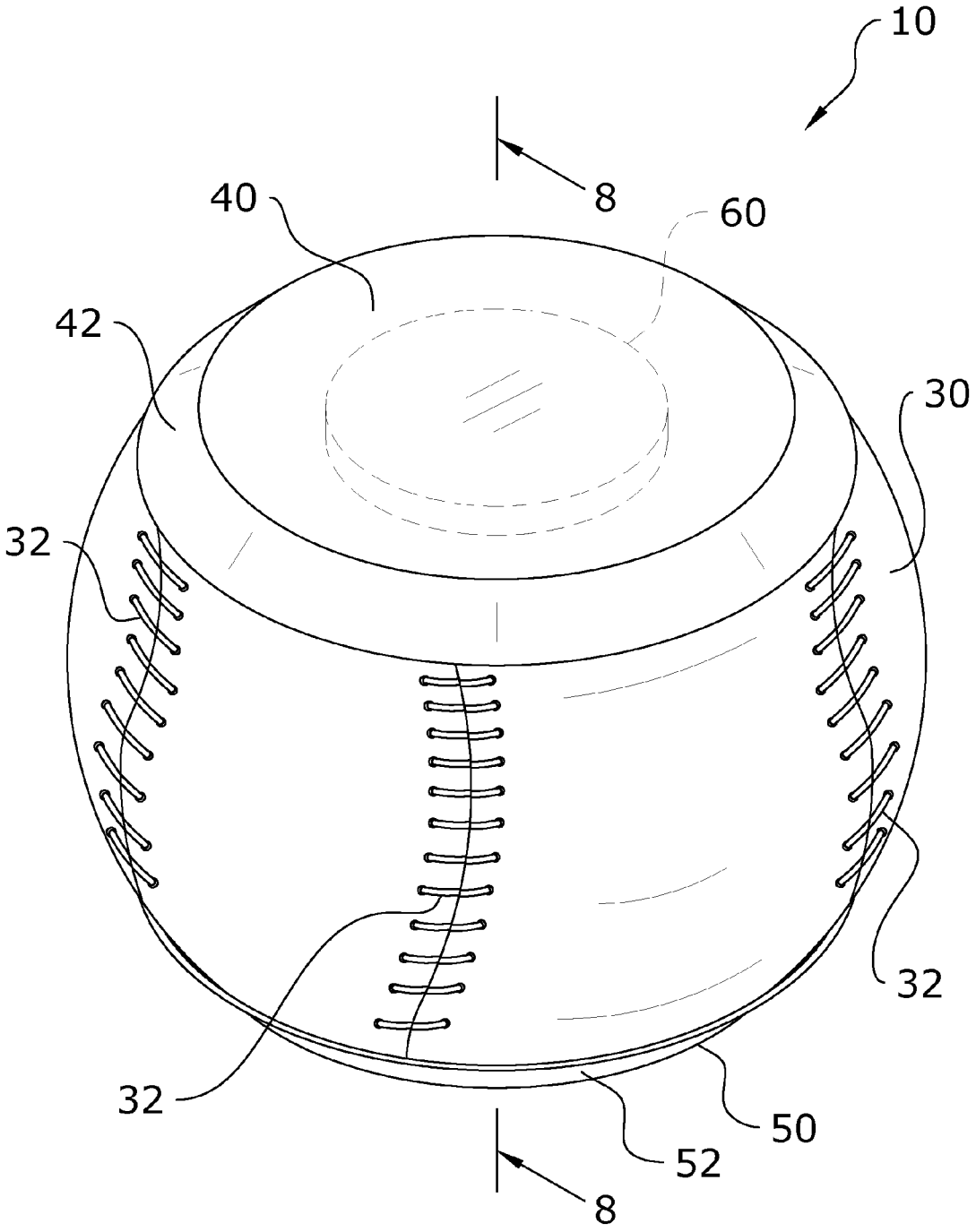
FIG. 6 is an upper perspective view of the second embodiment of the present invention illustrating the usage of weights on the sides of the ball.
Figure 7:
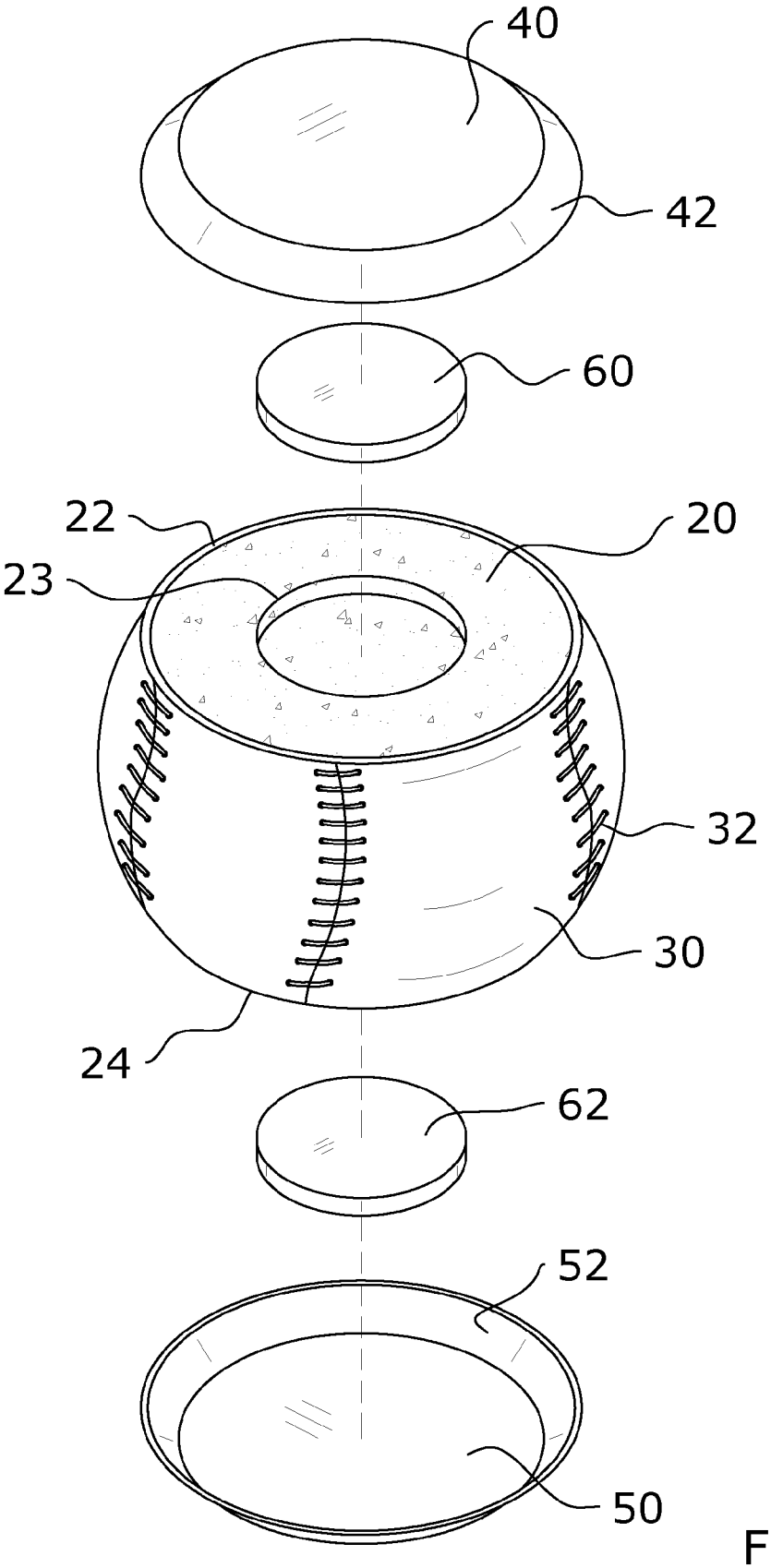
FIG. 7 is an exploded upper perspective view of the second embodiment of the present invention.
Figure 8:
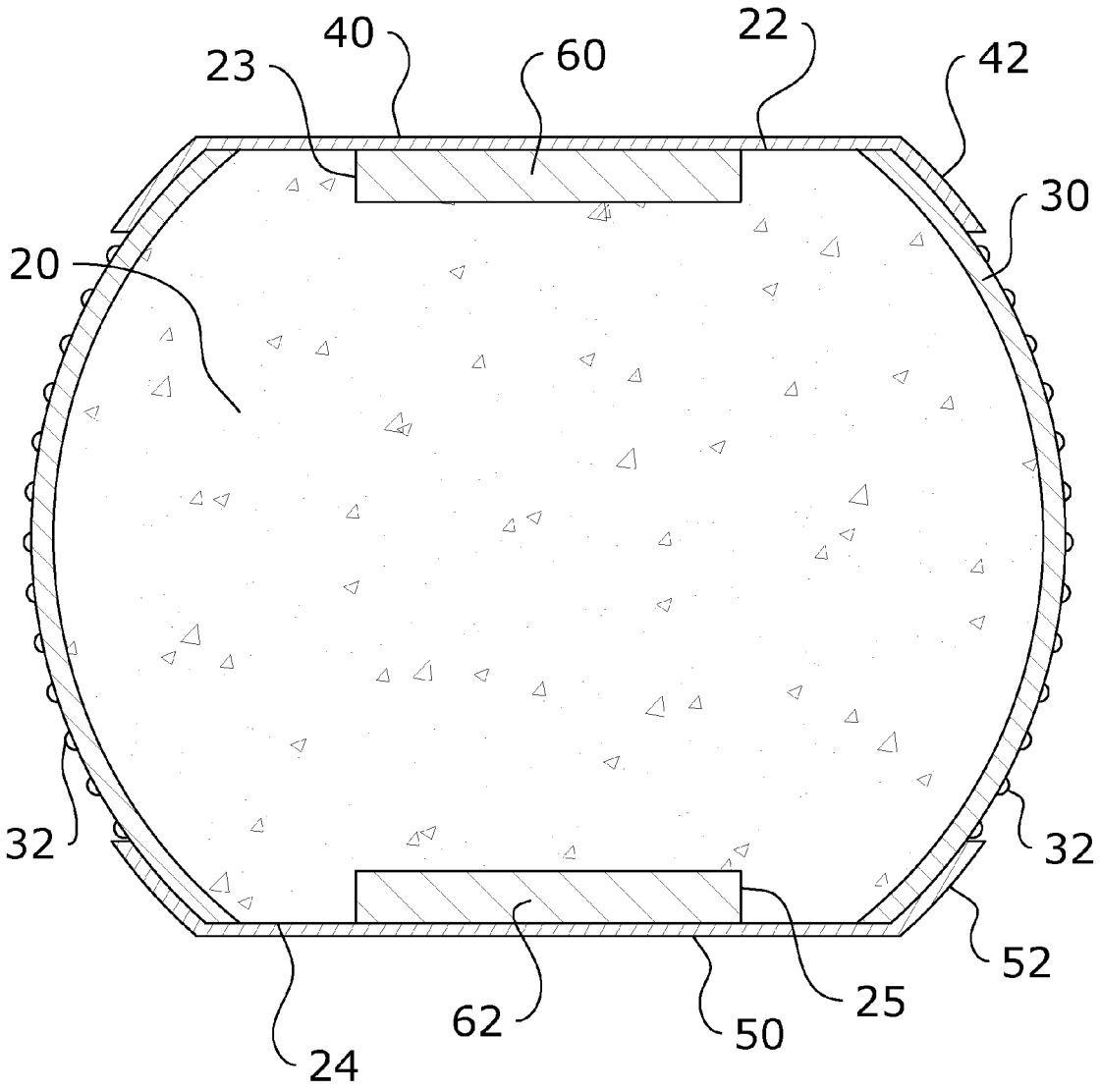
FIG. 8 is a cross sectional view taken along line 8-8 of FIG. 6.

FIGS. 6 through 8 illustrate a second embodiment having a first weight 60 concentrically attached to the first side 22 and a second weight 62 concentrically attached to the second side 24. It is preferable that the combined weight of the first weight 60 and the second weight 62 along with the core 20, the exterior cover 30, the first cover 40 and the second cover 50 be between 5 to 5¼ ounces avoirdupois as specified in Official Rule 1.05 of Major League Baseball. Official Rule 1.05 of Major League Baseball specifies the following: "The ball shall be a sphere formed by yarn wound around a small core 20 of cork, rubber or similar material, covered with two stripes of white horsehide or cowhide, tightly stitched together. It shall weigh not less than five nor more than 5¼ ounces avoirdupois and measure not less than nine nor more than 9¼ inches in circumference."

The first weight 60 and the second weight 62 are preferably each comprised of a circular disk shape as shown in FIG. 7 of the drawings. The core 20 preferably includes a first cavity 23 extending into the first side 22 and a second cavity 25 extending into the second side 24 to receive the first weight 60 and second weight 62 respectively. The first weight 60 and the second weight 62 may be attached within the first cavity 23 and second cavity 25 respectively with adhesive or other attachment devices. It is further preferable that the first weight 60 and the second weight 62 not extend past the first side 22 and the second side 24 of the core 20. In particular, it is preferable that the first weight 60 and the second weight 62 are substantially flush with the first side 22 and the second side 24.

Figure 9:
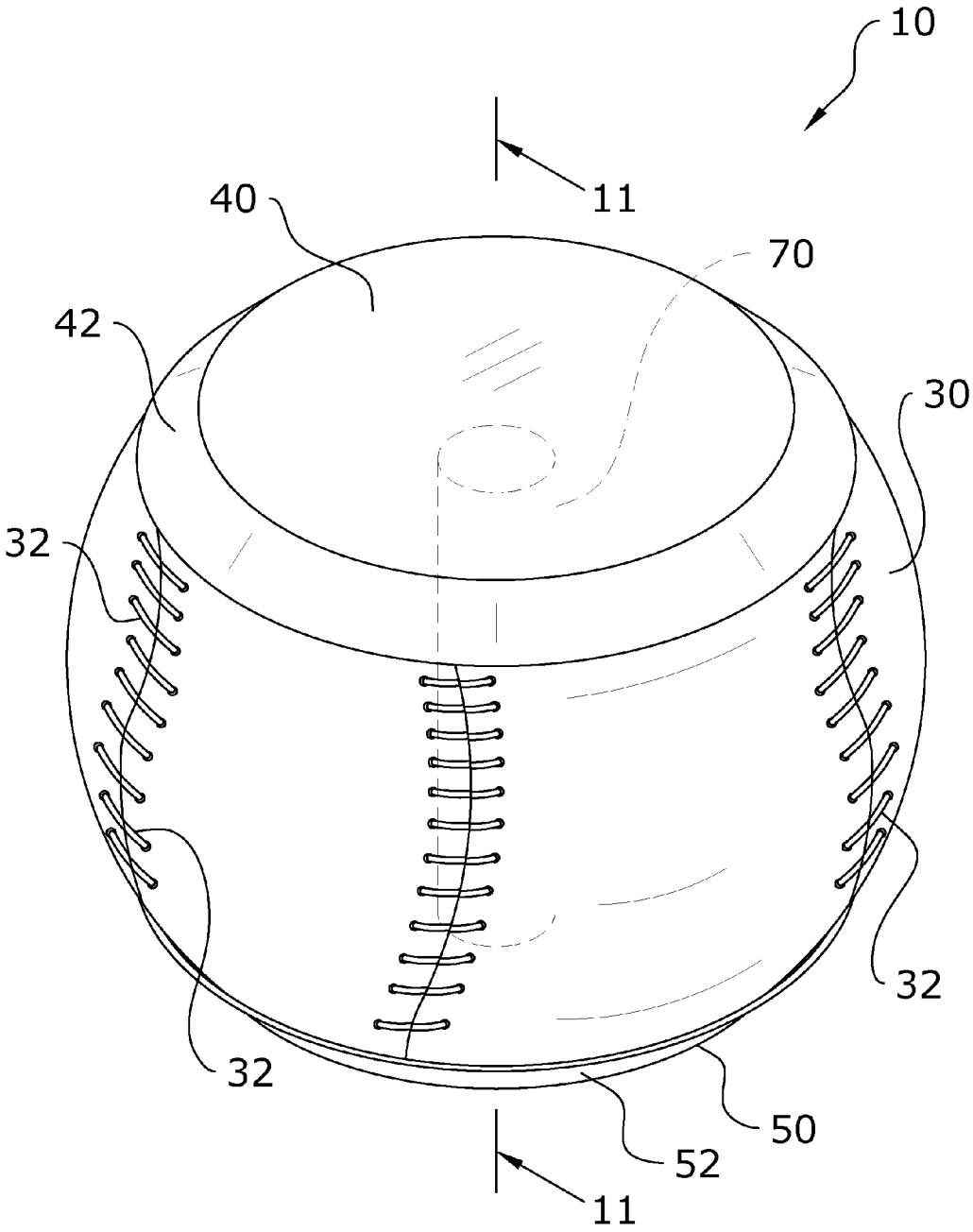
FIG. 9 is an upper perspective view of the third embodiment of the present invention illustrating the usage of an elongated weight within the ball.
Figure 10:
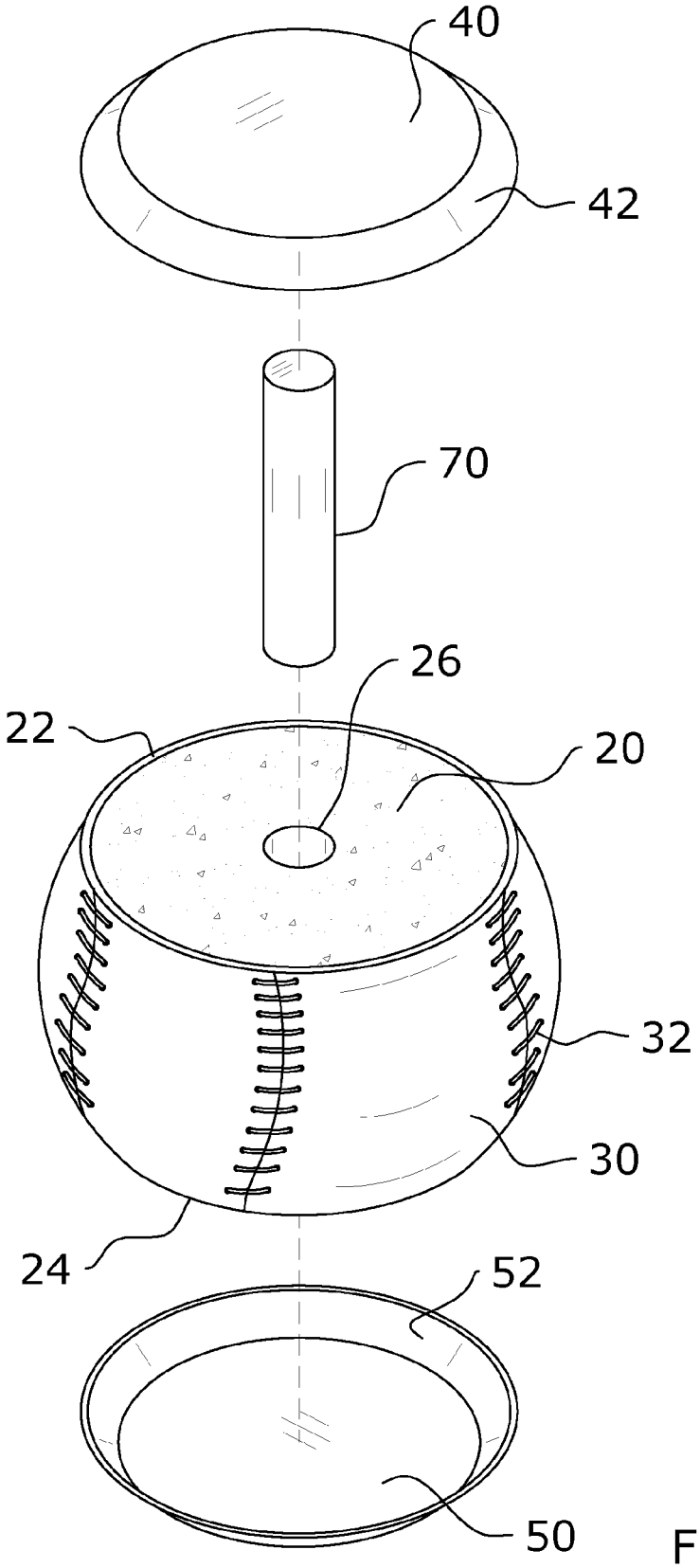
FIG. 10 is an exploded upper perspective view of the third embodiment of the present invention.
Figure 11:
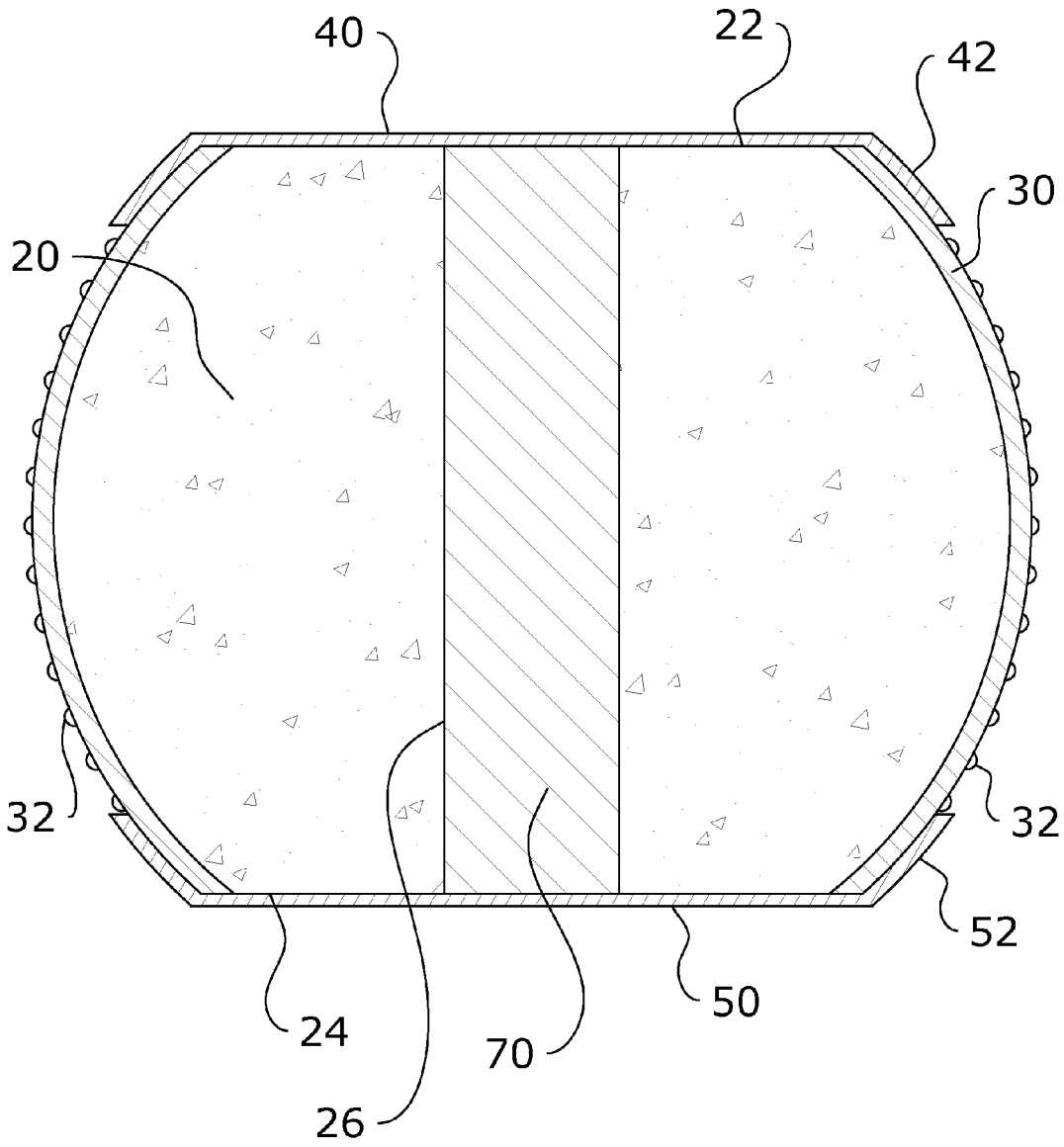
FIG. 11 is a cross sectional view taken along line 11-11 of FIG. 9.
Figure 12A:
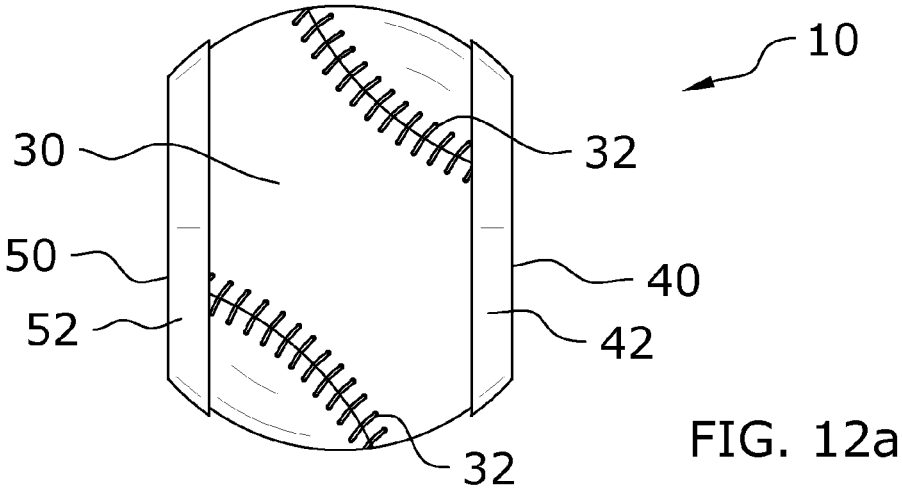
FIG. 12*a* is a side view of the present invention showing a slider grip for right-handed pitchers.
Figure 12B:
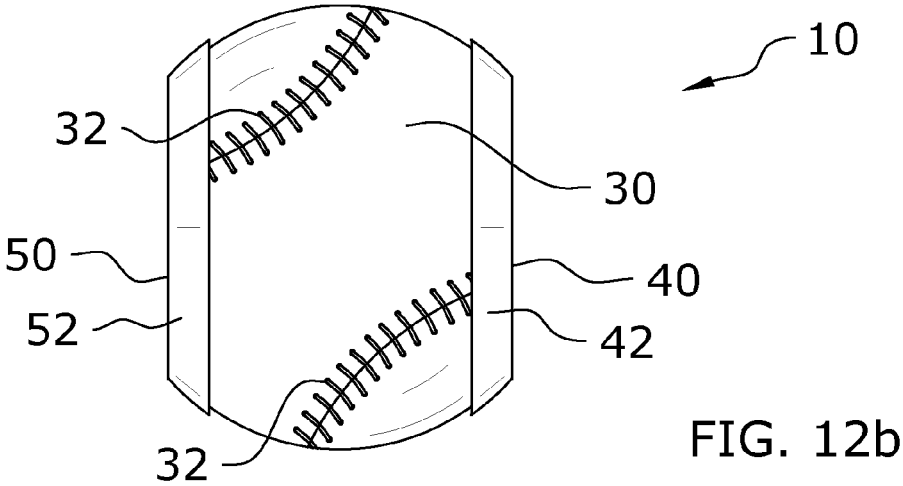
FIG. 12*b* is a side view of the present invention showing a slider grip for left-handed pitchers.
Figure 12C:
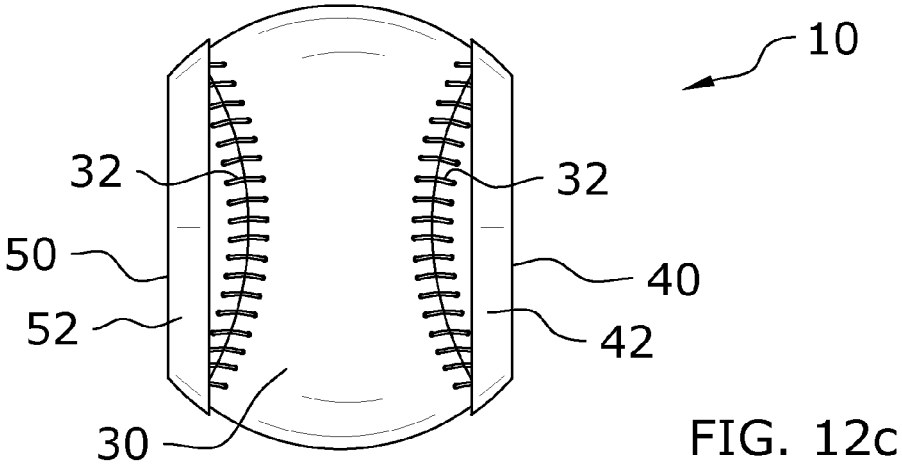
FIG. 12*c* is a side view of the present invention showing a two-seam fastball grip.

FIGS. 9 through 11 illustrate a third embodiment comprised of a single elongated weight 70 that concentrically extends between the first side 22 and the second side 24. In particular the elongated weight 70 extends through an aperture 26 within the core 20 that concentrically extends between the first side 22 and the second side 24. The elongated weight 70 may be attached within the core 20 via friction or attachment device (e.g. adhesive).

The weights 60, 62, 70 may be comprised of various types of materials such as but not limited to metal. It is preferable that the weights 60, 62, 70 be comprised of a material significantly denser than the core 20.

E. Manufacture of Preferred Embodiment.

In order to closely represent a conventional baseball or softball, it is preferable that a conventional baseball or softball be used initially to manufacture the present invention. In particular, a completely spherical baseball or softball is provided with the exterior cover 30 and seams 32. To create the first side 22 and the second side 24, a manufacturer cuts into the ball to form the first side 22 and then cuts into the ball opposite thereof to form the second side 24 thereby exposing the core 20 of the ball. It can be appreciated that the first side 22 and the second side 24 may be cut simultaneously or independent of one another. Furthermore, the formation of the first side 22 and the second side 24 determines the gripping created by the seams 32 as illustrated in FIGS. 4, 12*a*, 12*b* and 12*c* of the drawings.

The manufacturer can determine if they would like to include additional weight within the core 20 to offset the loss weight due to the cutting of the first side 22 and the second side 24. If no weight is used, then the manufacturer simply attaches the first cover 40 and the second cover 50 to the first side 22 and second side 24 of the core 20 as shown in FIGS. 3 through 4 of the drawings. It is preferable to have a first overlap portion 42 for the first cover 40 that is attached to the exterior cover 30 with adhesive or related fastener (the same applies to a second overlap portion 52 for the second cover 50). If a weight is used, the weight is attached to the core 20 and then the first cover 40 and the second cover 50 are attached. Alternatively, the core 20 may be formed initially with the first side 22 and the second side 24 with the exterior cover 30, first cover 40, second cover 50 and any additional weight attached thereafter.

F. Operation of Preferred Embodiment.

In use, the assembled ball training device 10 assists a pitcher in efficiently throwing a pitch with increased distance, accuracy and velocity. Depending upon how the seams 32 are formed in the exterior cover 30, the pitcher is able to grip the ball training device 10 with their fingers (e.g. thumb 12, index finger 14, middle finger 16 as shown in FIG. 1) to achieve a desired grip and release. After gripping the ball training device 10, the pitcher throws and releases the ball training device 10 similar to a conventional baseball or softball to achieve the desired pitch (e.g. fastball, slider, curve, etc.). If the ball training device 10 is thrown with the proper release, the ball training device 10 will travel smoothly and precisely through the air. If the ball training device 10 is thrown with an improper release, the ball training device 10 will not travel smoothly and precisely through the air resulting in a "wobble" during flight thereby providing immediate feedback to the pitcher and/or coach which can then be utilized to improve the release.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A ball training device, comprising:

a core having a first side, a second side and a middle portion between said first side and said second side;

wherein said middle portion is comprised of a spherical shape;

wherein said first side and said second side are not spherical shaped;

an exterior cover surrounding said middle portion of said core; and a first cover attached to said first side and a second cover attached to said second side, wherein said first cover includes a first overlap portion that extends over a portion of said exterior cover, and wherein said second cover includes a second overlap portion that extends over a portion of said exterior cover.

2. The ball training device of claim 1, including a plurality of seams attached to said exterior cover.

3. The ball training device of claim 1, wherein said first side and said second side are planar.

4. The ball training device of claim 3, wherein said first side and said second side are substantially parallel to one another.

5. The ball training device of claim 3, wherein said first side and said second side are circular and equal in size.

6. The ball training device of claim 1, wherein said first side and said second side are circular and equal in size.

7. The ball training device of claim 1, wherein said first cover and said second cover are comprised of the same material as said exterior cover.

8. The ball training device of claim 1, wherein said first side is distally spaced from said second side between 1.75 inches to 2 inches.

9. A ball training device, comprising:

a core having a first side, a second side and a middle portion between said first side and said second side;

wherein said middle portion is comprised of a spherical shape;

wherein said first side and said second side are not spherical shaped;

wherein said first side and said second side are planar;

wherein said first side and said second side are substantially parallel to one another;

wherein said first side and said second side are circular and equal in size;

at least one weight attached to said core;

an exterior cover surrounding said middle portion of said core;

a plurality of seams attached to said exterior cover representing a baseball or a softball; and a first cover attached to said first side and a second cover attached to said second side;

wherein said first cover includes a first overlap portion that extends over a portion of said exterior cover, and wherein said second cover includes a second overlap portion that extends over a portion of said exterior cover.

10. A ball training device, comprising:

a core having a first side, a second side and a middle portion between said first side and said second side;

wherein said middle portion is comprised of a spherical shape;

wherein said first side and said second side are not spherical shaped;

an exterior cover surrounding said middle portion of said core; and a first cover attached to said first side and a second cover attached to said second side, wherein said first cover and said second cover are comprised of the same material as said exterior cover.

11. The ball training device of claim 10, including a plurality of seams attached to said exterior cover.

12. The ball training device of claim 10, wherein said first side and said second side are planar.

13. The ball training device of claim 12, wherein said first side and said second side are substantially parallel to one another.

14. The ball training device of claim 12, wherein said first side and said second side are circular and equal in size.

15. The ball training device of claim 10, wherein said first side and said second side are circular and equal in size.

16. The ball training device of claim 10, wherein said first cover and said second cover are comprised of the same material as said exterior cover.

17. The ball training device of claim 10, wherein said first side is distally spaced from said second side between 1.75 inches to 2 inches.

18. The ball training device of claim 10, wherein said first cover includes a first overlap portion that extends over a portion of said exterior cover, and wherein said second cover includes a second overlap portion that extends over a portion of said exterior cover.

* * * * *